US006309761B1

(12) United States Patent
Guesdon et al.

(10) Patent No.: US 6,309,761 B1
(45) Date of Patent: Oct. 30, 2001

(54) PROCESS OF ALUMINIZING STEEL TO OBTAIN AND INTERFACIAL ALLOY LAYER AND PRODUCT THEREFROM

(75) Inventors: Philippe Guesdon, Paris; Jean-Pierre Godin, Mogneville; Eric Lesueur, Saint Just en Chaussee, all of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/506,586

(22) Filed: Feb. 18, 2000

(30) Foreign Application Priority Data

Feb. 18, 1999 (FR) ..... 99 02050

(51) Int. Cl.[7] ..... B32B 15/01; B05D 1/18

(52) U.S. Cl. ..... 428/653; 148/527; 148/531; 148/535; 427/430.1; 427/431; 427/436; 428/926; 428/933; 428/939

(58) Field of Search ..... 428/653, 926, 428/933, 939; 427/430.1, 431, 436; 148/527, 531, 535

(56) References Cited

U.S. PATENT DOCUMENTS

| | | | |
|---|---|---|---|
| 1,409,017 | | 3/1922 | Ortiz et al. . |
| 2,235,729 | * | 3/1941 | Schon ..... 148/531 |
| 3,058,206 | | 10/1962 | Mets . |
| 5,447,754 | | 9/1995 | Jasper . |

FOREIGN PATENT DOCUMENTS

| | | |
|---|---|---|
| 0 496 678 | 7/1992 | (EP) . |
| 0 760 399 | 3/1997 | (EP) . |
| 1.456.754 | 1/1967 | (FR) . |

OTHER PUBLICATIONS

Patent Abstracts of Japan, vol. 003, No. 079 of 54053632 published Apr. 27, 1979. Takada Yoshio. Entitled: "Formation Method for Molten Aluminum Resistant Film on Iron Group Metal Surface".

* cited by examiner

*Primary Examiner*—Robert R. Koehler
(74) *Attorney, Agent, or Firm*—Oblon, Spivak, McClelland, Maier & Neustadt, P.C.

(57) ABSTRACT

A process in which a steel is dipped in an aluminum-based bath wherein the composition and mean temperature of the bath and the immersion temperature of the steel are adjusted to obtain, in the immersion zone of the steel, a local bath temperature and composition resulting in an equilibrium with the solid phase designated as $\theta \equiv FeAl_3$. Dipping is performed at a temperature higher than the temperatures normally employed in the art and a coating is obtained having at the interface with the steel an alloy layer significantly smaller in thickness than the art. The coating obtained better resists cracking and corrosion.

15 Claims, 2 Drawing Sheets

PROCESS OF ALUMINIZING STEEL TO OBTAIN AND INTERFACIAL ALLOY LAYER AND PRODUCT THEREFROM

BACKGROUND OF THE INVENTION

1. Field of the Invention

The invention relates to a process for aluminizing steel in which a steel is dipped in a liquid bath containing aluminum.

2. Discussion of the Background

When a dipping process is used to provide an aluminum layer on steel, the coating which is obtained on the steel generally is stratified into several layers. These include:

an inner layer in contact with the steel, composed of one or more alloys of aluminum from the bath and iron from the steel. It also is referred to as an alloyed layer; and an outer layer, generally thicker, comprising an aluminum-based main phase.

Since the inner alloy layer tends to be brittle in nature, steps are generally taken to limit thickness. These include the addition of materials to the dipping baths to inhibit alloying between aluminum and steel. Silicon is the most widely used alloying inhibitor. Its weight concentration in the dipping bath generally ranges between 3 and 13%.

In continuous aluminizing processes, the dipping baths are saturated with iron due to a partial dissolution of the steel in the bath. This saturation is known to lead to the formation of mattes and the liquid bath is in equilibrium with the solid phase of these mattes.

Under the usual conditions of aluminizing, the two previously cited layers which form the aluminized coating may be more precisely described as follows. The alloyed interfacial layer is composed essentially of a phase designated as τ5 and/or a phase designated as τ6. According to the conditions of aluminizing, this layer may be subdivided into several alloyed sub-layers, particularly in the case of the present invention. The outer layer is composed principally of aluminum in the form of broad dendrites. These dendrites are saturated with iron and, as the case may be, with silicon in solid solution.

The τ5 phase has a hexagonal structure and crystallizes in the form of globular grains; it sometimes is referred to as $\alpha_H$ or H. The iron content of this phase generally ranges between about 29 and about 36% by weight; the silicon content of this phase generally ranges between about 6 and about 12% by weight; the balance is composed principally of aluminum. The chemical composition corresponds approximately to the formula $Fe_3Si_2A_{12}$.

The τ6 phase has a monoclinic structure and crystallizes in the form of elongated, flat grains; it sometimes is referred to as β or M. The iron content of this phase generally ranges between about 26 and about 29% by weight; the silicon content of this phase generally ranges between about 13 and about 16% by weight; the balance is composed principally of aluminum. The chemical composition corresponds approximately to the formula $Fe_2Si_2Al_9$.

FIG. 1 is a three-dimensional representation of an Al—Si—Fe ternary phase diagram, where the variations—vertical axis—of the temperature of equilibrium of a liquid phase with different solid phases are designated as follows: $FeAl_3 \equiv \Theta$, $Fe_3Si_2Al_{12} \equiv \tau_5$, $Fe_2Si_2Al_9 \equiv \tau_6$, $FeSiAl_3$, $\equiv \tau_2$, $FeSi_2Al_4 \equiv \delta$, Al≡aluminum, Si≡silicon, and other phases such as $\tau_3\tau_4$.

The θ phase plays a significant role in the present invention. Its structure is monoclinic and it may contain up to about 6% by weight of silicon in solid solution; the chemical composition therefore corresponds approximately to the formula $FeAl_3$.

In FIG. 1, Si=0% and Fe=0% which means Al=100%. This Figure makes it possible to establish the nature of the solid phases which are capable of being in equilibrium with an aluminizing bath in the liquid state, in terms of the composition of the bath, and the temperature of the bath at equilibrium.

FIG. 2 is a projection of FIG. 1; the liquid-solid equilibrium temperature is determined with the aid of isothermal curves. The temperature interval between each curve is 20° C.

Table 1 summarizes the possible composition of the θ, τ5 and τ6 phases.

TABLE 1

Composition of the bath and of the main pbases obtained after solidification of the aluminum coating

| Composition Weight % | Al | Si | Fe |
|---|---|---|---|
| Bath | >86 | 3 to 13% | Saturation (ex.: 3%) |
| Eutectic | 87 | 12.2 | 0.8 |
| τ6 Phase | 55 to 61 | 13 to 16 | 26 to 29 |
| τ5 Phase | 55 to 62 | 6 to 12 | 29 to 36 |
| θ Phase | 52 to 64 | 0 to 6% | 36 to 40 |

An Al—Si—Fe eutectic with a melting temperature of 578° C. is shown in Table 1.

As indicated above, the inner interfacial layer of the aluminum-based coating tends to be brittle and has a tendency to crack at the time of shaping of the aluminized castings. This cracking results in a decrease in the corrosion protection provided by the coating. To obtain coatings which are more resistant to cracking during shaping and to corrosion, it is desirable to limit the thickness of this interfacial layer.

According to the prior art, in order to achieve this purpose, the following two conditions should be maintained:

1. dipping the steel casting in the bath at a temperature as low as possible to limit the growth of the interfacial alloy layer;
2. using a liquid aluminizing bath whose composition corresponds, at liquid-solid equilibrium, to the area of existence of the $\tau_6$ or $\tau_5$ solid phases.

Condition 2 leads to the use of baths with silicon contents in excess of 7.5%, and preferably 9% (see FIG. 1 and 2).

According to document EP 0 760 399 (NISSHIN STEEL) and document JP 4 176 854-A (NIPPON STEEL), in a continuous process for aluminizing a steel strip, it is recommended that the strip be immersed at a temperature below the mean temperature of the bath. Thus, for a bath containing 9% silicon with the temperature generally ranging between 650 and 680° C., the immersion temperature of the strip should be at a maximum of 640° C.

SUMMARY OF THE INVENTION

It is an object of the present invention to provide an improved method for aluminizing steel which yields an appreciably smaller interfacial layer thickness.

It is another object of the invention to provide an aluminized steel having an improved Al—Fe—Si alloy layer.

These and other objects of the invention have been attained by a process for aluminizing a steel in which the steel is dipped in an aluminum-based liquid bath, wherein the composition and mean temperature of the bath and the temperature of immersion of the steel in the bath, are adjusted to obtain in the immersion zone a local bath temperature and composition which results in an equilibrium with the solid phase designated as θ, the composition of which corresponds approximately to the chemical formula $FeAl_3$.

The process of the invention also may include one or more of the following:

- the composition and mean temperature of the bath are adjusted to be in equilibrium with the phase designated as $\tau_5$ or the phase designated as $\tau_6$, preferably with the $\tau_6$ phase.
- this liquid bath is saturated with iron.
- the immersion temperature of the steel is higher than the bath temperature.
- if the silicon content in the bath is approximately 8%, the immersion temperature ranges between about 700 and about 740° C., preferably about 720° C.
- if the silicon content in the bath is approximately 9%, the immersion temperature ranges between about 720 and about 765° C., preferably about 730° C.
- if the silicon content in the bath is approximately 9.5%, the immersion temperature ranges between about 740 and about 760° C., preferably about 740° C.

The invention also provides an aluminized steel sheet having an Al—Fe—Si alloy layer and a surface aluminum layer wherein the alloy layer comprises, at the point of contact with the steel substrate, a sub-layer composed essentially of θ phase.

The thickness of this alloy layer preferably is less than or equal to about 3 μm.

DETAILED DESCRIPTION OF THE PREFERRED EMBODIMENTS

Figure 1:
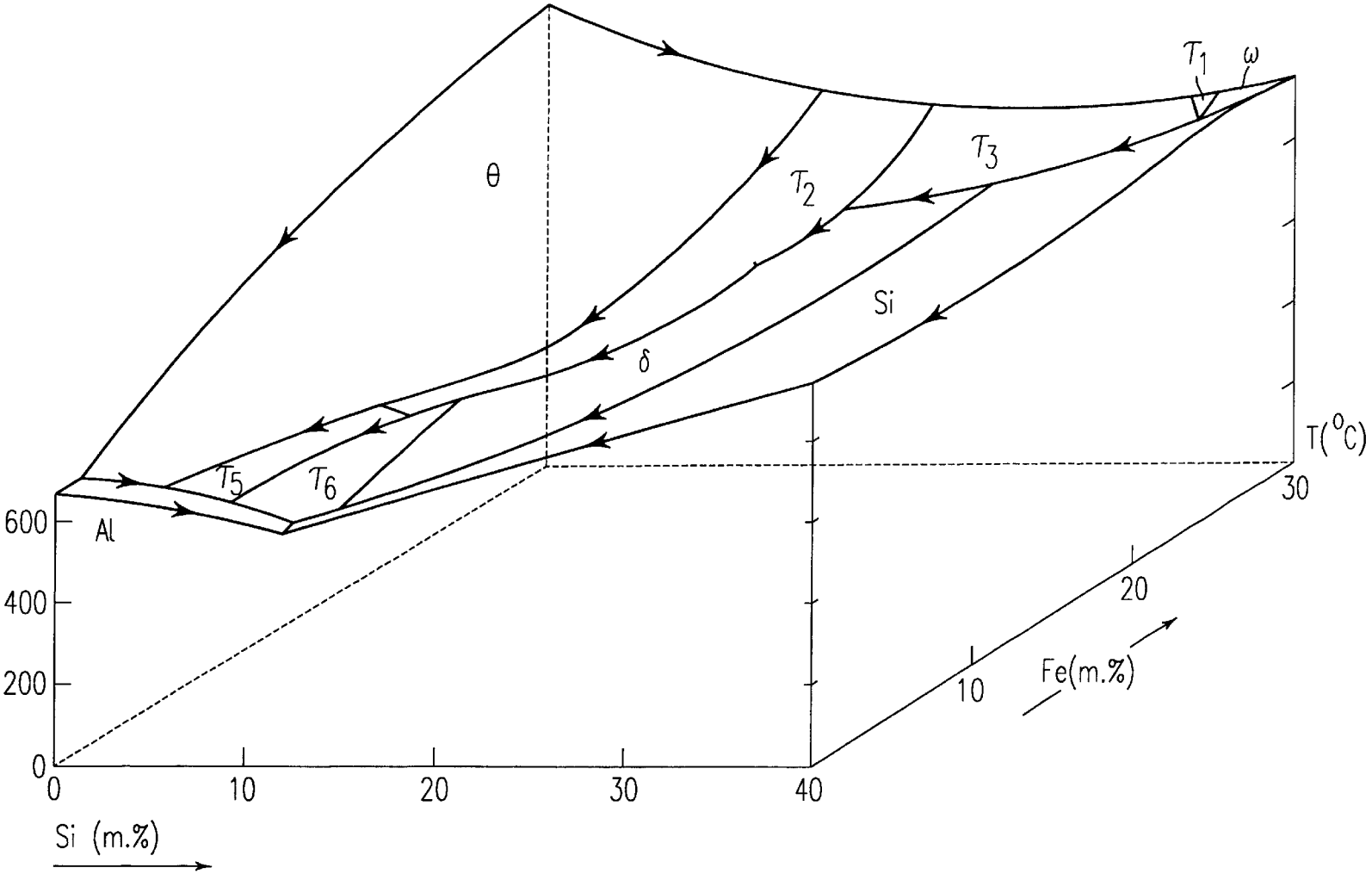
FIG. 1 represents a three-dimensional Al—Si—Fe ternary phase diagram.

The aluminizing process according to the invention now will be described in the context of continuous coating of a steel strip.

The aluminizing plant conventionally includes means for cleaning, means for annealing, means for dipping in an aluminizing bath, means for drying the aluminum-based layer produced on the strip, means for cooling and means for moving the strip continuously in the plant.

To proceed with aluminizing, there is used, as in the prior art, a bath the composition of which corresponds to the area of existence of the $\tau_6$ or $\tau_5$ phase (condition 2 above).

According to the invention, the temperature of the strip when it enters the bath (i.e., the immersion temperature of the strip) is higher than the mean temperature of the bath. Since the strip enters the bath at a temperature higher than that of equilibrium with the $\tau_6$ or $\tau_5$ phase, it causes a local heating of the bath in the strip-immersion zone. This local heating brings about a dissolution of the surface ferrite of the strip and an iron enrichment of the immersion zone. Also in accordance with the invention, the temperature and iron enrichment of the immersion zone should be sufficiently high so that, in this zone, the solid phase capable of being in equilibrium with the liquid phase corresponds to the $\theta \equiv FeAl_3$ phase. Accordingly, in the immersion zone, the first solid sub-layer being deposited on the steel strip corresponds to the $FeAl_3 \equiv \theta$phase.

Thus, the immersion zone is therefore a zone of the bath which is locally in equilibrium with the θ phase; this immersion zone corresponds to a zone which extends:

- in thickness, up to a distance of approximately 30 μm from the surface of the strip;
- in length, along the strip between the starting point of direct contact between the solid surface of the steel and the liquid bath and the point at which the conventional interfacial layer composed of $\tau_5$ or $\tau_6$ phase on the first θ-phase sub-layer characteristic of the invention, begins to solidify.

Continuing its progression in the bath after the immersion zone, the strip temperature is at the mean temperature of the bath which corresponds to the temperature of equilibrium with the $\tau_5$ or $\tau_6$ solid phase. In this way the main interfacial layer composed of $\tau_5$ or $\tau_6$ phase, is formed on the first θ-phase sub-layer. At the bath outlet, the strip layer is dried and solidifies on cooling. The aluminized strip thus produced according to the invention, has an interfacial alloyed layer which includes, at the point of contact with the steel surface, a sub-layer composed essentially of the θ phase.

In the process of the invention, the main characteristic is a strip-immersion temperature which is both:

- sufficiently high so that the first solid component formed at the contact surface with the steel crystallizes in the θ phase,
- sufficiently low to limit the thickness of the interfacial alloyed layer.

Even though the immersion temperatures according to the invention are significantly higher than those used in the prior art to limit the thickness of the interfacial alloyed layer, contrary to all expectations, the interfacial alloyed layer obtained according to the invention has a much smaller thickness than that in the prior art. Accordingly, the aluminized strip according to the invention is much more resistive to both corrosion and cracking.

Without intending to be confined to any definitive explanation of the invention, it is postulated that, among the alloyed phases, the θ phase might be the one which can be formed most rapidly on the strip at the outset of immersion. This rapid formation is thought to limit the quantity of ferrite which passes into solution in the bath, which also limits the thickness of the alloyed layer.

In accordance with the teaching of the previously cited document EP 0 760 399, the prior art has advised practitioners to shorten the duration of immersion and/or the duration between exit from the bath and the end of solidification of the coating. The present invention, provides conditions appropriate for forming the θ phase on the substrate as a priority.

The invention is applicable to cold sheets and hot sheets, to all types of steel which can be aluminized by dipping. These include:

- type IF carbon steels (see example 1), aluminum killed, microalloyed or multiphase steels such as the so-called "Dual Phase" or "TRIPS" steels;
- ferritic steels comprising between 0.5% and 20% by weight chromium, in particular stainless steels generally comprising between 6% and 20% chromium.

Suitable steels may contain alloy elements such as Ti (generally between 0.1% and 1% by weight), and Al (generally between 0.01% and 0.1% by weight), for example ferritic stainless steel referenced as AISI 409. Other addition elements appropriate for the properties sought and/or other residual elements may be present in these steels. When the steel contains these alloying, addition and/or residual elements, the coating obtained on the sheet generally is enriched in these elements.

In the case of aluminizing a steel containing at least 0.5% by weight chromium, the invention makes it possible to limit, within an aluminum-based surface layer of the coating, the occurrence of phases enriched in chromium. These phases are related to the previously described $\tau_5$ phase. They generally contain the same proportion of Si as this $\tau_5$ phase, and generally contain more than 5% by weight chromium, usually between 6% and 17% chromium. The presence of this phase in the surface layer of the coating is detrimental to the quality of the coating and the present invention makes it possible to limit if not eliminate this phase in the surface layer of the coating.

Advantageously, in the aluminizing process according to the invention, since the strip to be coated is at a temperature higher than that of the bath, the strip may be used to reheat the bath, to offset thermal losses in the bath and/or to maintain the bath at the desired temperature. In terms of energy conservation, this process is advantageous since in the succession of stages through which the strip passes, i.e., annealing, cooling to immersion temperature, dipping, drying, cooling for solidification—a lesser degree of cooling is necessary after annealing than in the prior art.

To implement the process, the composition and mean temperature of the bath preferably are adjusted to be in equilibrium with the $\tau_6$ phase. It is noted that the mattes which result from these baths are less likely to adversely affect the quality of the coating obtained than with the mattes which result from other baths and particularly those in which the composition and mean temperature are adjusted to be in equilibrium with the $\tau_5$ phase. To proceed according to this variant, it suffices, in accordance with the indications provided by FIG. 2, to increase the silicon content and/or to lower the mean temperature of the bath.

For implementation of the invention, reliance should be placed on the phase diagrams corresponding to the grade of steel used. The boundaries between areas of existence of phases represented in the diagrams of FIGS. 1 and 2 may vary according to the grade of steel used, for example according to the chromium content.

The following examples are for illustrative purposes only and are not intended to limit the invention unless stated otherwise.

EXAMPLE 1

This example illustrates the invention wherein a steel strip of grade IF-TI ("IF" means "Interstitial Free", "Ti" means that the carbon in the steel is blocked by titanium) was dipped into a conventional aluminizing bath saturated with iron, containing 9% by weight silicon and maintained at a mean temperature of approximately 675° C. Under these conditions, the bath becomes naturally saturated with iron until the occurrence of solid mattes. The liquid phase of the bath is in equilibrium with the $\tau_5 \equiv Fe_3Si_2Al_{12}$ solid phase.

Different aluminizing tests were conducted on the steel strips under conditions identical in all respects except for the strip-immersion temperature; the cumulative duration of immersion in the bath and solidification of the coating was on the order of 13 seconds. The thickness of the alloyed interfacial layer of the coating was evaluated in a normal manner; for example, metallographic observations were effected on sections of these samples.

Table II summarizes the results obtained in terms of immersion temperature.

TABLE II

Thickness in terms of strip temperature on immersion.

| Strip Temperature: | 675° C. | 720° C. | 730° C. | 750° C. | 765° C. |
|---|---|---|---|---|---|
| Thickness of the alloyed layer (μm) | 5–6 | 6–7 | 2–3 | 4–5 | 7 |

On the basis of the teachings of the prior art, with a view to obtaining an interfacial alloyed layer thickness as small as possible, the strip would have been dipped at a temperature lower than or equal to 675° C. (=bath temperature).

According to the invention as illustrated by these results, with a view to the same purpose, it is advisable to dip the strip at a temperature higher than 720° C. and lower than 765° C., preferably on the order of 730° C.

Figure 2:
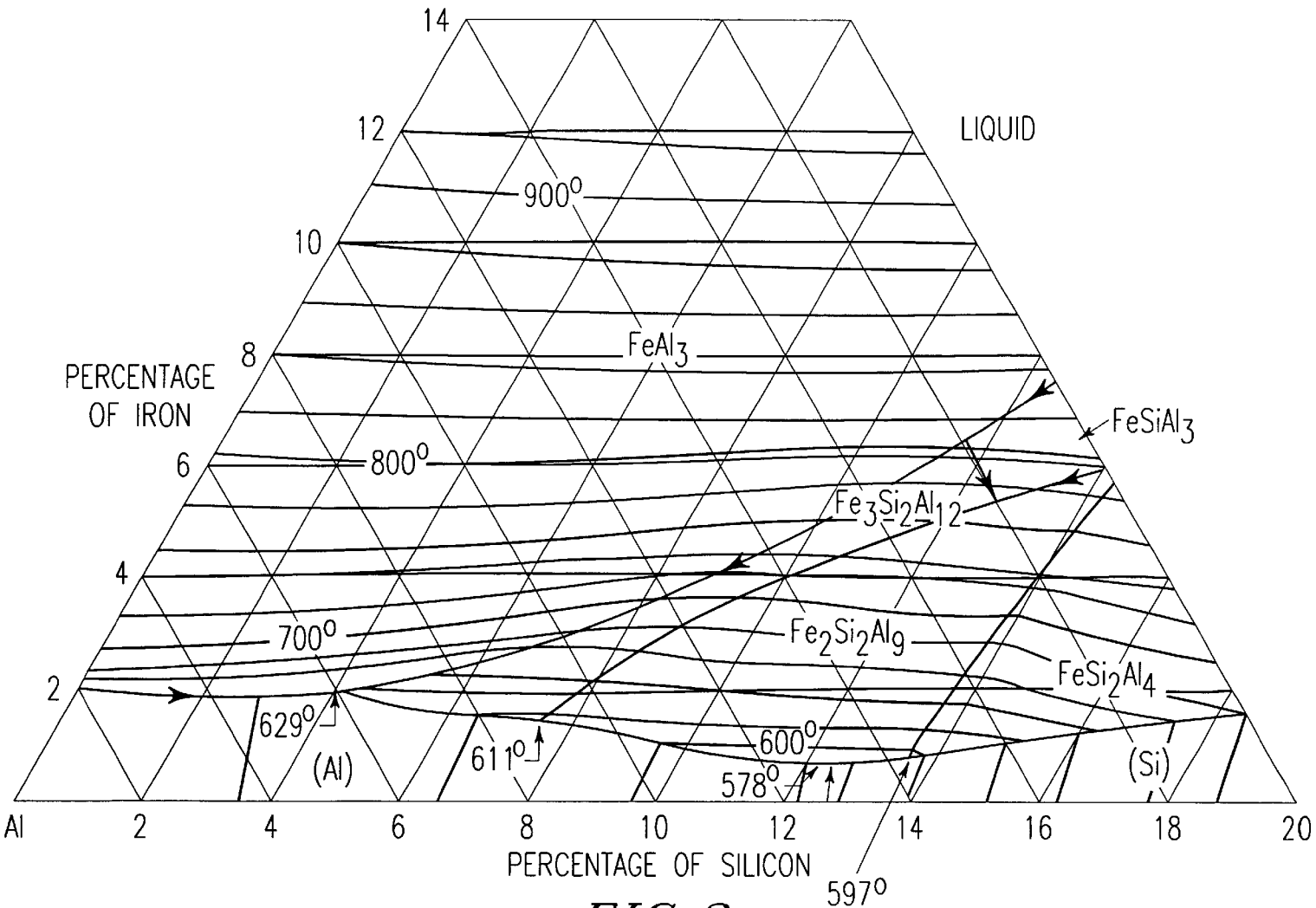
FIG. 2 is a projection of FIG. 1, in which the liquid-solid equilibrium temperatures are represented with the aid of isothermal curves 20° C. apart.

By referring to FIGS. 1 and 2, it is seen clearly that, for this silicon content (9%), the temperature range indeed corresponds to the area of equilibrium of the iron-saturated bath with the θ solid phase.

When one proceeds in this temperature range, in particular at 730° C., there is obtained a coated sheet wherein the interfacial alloyed layer has a sub-layer composed essentially of θ phase directly in contact with the steel, and the remainder of the alloyed layer comprising essentially $\tau_5$ phase. Overall, the total thickness of the alloyed layer is much smaller than in the prior art since, in accordance with the results hereinabove, an average thickness less than or equal to 3 μm is attained.

EXAMPLE 2

Proceeding as in Example 1, except that the bath contained 8% by weight silicon and its temperature was maintained at approximately 650° C.: the cumulative duration of immersion in the bath and solidification of the coating was on the order of 11 seconds. Table III summarizes the results obtained in terms of the immersion temperature.

TABLE III

Thickness in terms of strip temperature on immersion.

| Strip Temperature: | 650° C. | 680° C. | 720° C. | 730° C. | 740° C. |
|---|---|---|---|---|---|
| Thickness of the alloyed layer (μm) | 4 | 5 | 2–3 | 3 | >3 |

In this Example, the optimal immersion temperature ranged between 680° C. and 740° C., preferably close to 720° C. According to FIG. 2, in order to reach the area of existence of the θ phase, the temperature should be higher than or equal to approximately 700° C.; the preferred temperature area therefore would correspond to a range of 700°–740° C.

EXAMPLE 3

Proceeding as in Example 1, except that the bath contained 9.5% by weight silicon and the temperature was maintained at approximately 650° C.; the cumulative duration of immersion in the bath and solidification of the coating was on the order of 10 seconds.

TABLE IV

| Thickness in terms of strip temperature on immersion. | | | | | | |
|---|---|---|---|---|---|---|
| Strip Temperature: | 650° C. | 700° C. | 715° C. | 740° C. | 765° | 760° |
| Thickness of the alloyed layer (μm) | 5–6 | 6–7 | 7 | 3 | 5 | 7–8 |

It is noted that the optimal immersion temperature ranged between 715° C. and 760° C., preferably close to 740° C. According to FIG. 2, in order to reach the area of existence of the θ phase, the temperature should be higher than or equal to approximately 740° C.; the preferred temperature area therefore would correspond to a range of 740°–760° C.

TABLE V

| Immersion temperature#in terrns df Si content in the bath. | | | |
|---|---|---|---|
| Si content in bath: | 8% | 9%. | 9.5% |
| Immersion temperature range (° C.) | 700–740 | 720–765 | 740–760 |
| Optimal temperature | 720° C. | 730° C. | 740° C. |

This application is based on French Application No. 99 02050, filed Feb. 18, 1999, the disclosure of which is incorporated herein in its entirety.

What is claimed is:

1. An aluminized steel, the coating of which comprises an Al—Fe—Si alloy layer and an aluminum-based outer surface layer, wherein the alloy layer comprises, at the contact of the steel substrate, a sub-layer composed essentially of θ phase.

2. A steel according to claim 1, wherein the thickness of the alloyed layer is less than or equal to about 3 μm.

3. A steel according to claim 1, which comprises a carbon steel.

4. A steel according to claim 1, which comprises a stainless steel.

5. A process for aluminizing a steel, comprising:

dipping the steel into an aluminum-based liquid bath;

maintaining a composition and a mean temperature of said bath and a temperature of said steel to obtain, in an immersion zone of the steel, a local bath temperature and bath composition thereby providing an equilibrium with a solid phase designated as θ, the composition of which corresponds approximately to the chemical formula $FeAl_3$;

continuing the progression of said steel in said bath beyond said immersion zone and adjusting the composition and the mean temperature of said bath to be in equilibrium with a phase designated as τ5 or a phase designated as τ6;

thereby forming an aluminized coating layer.

6. The process according to claim 5, wherein said immersion zone extends:

in thickness, up to a distance of approximately 30 μm from a surface of said steel, in length, along the surface of said steel between the beginning of direct contact between the steel surface and the liquid bath and the beginning of solidification of an interfacial layer composed of the τ5 or τ6 phase.

7. The process according to claim 5, wherein the composition and mean temperature of the bath are adjusted to be in equilibrium with the τ6 phase.

8. The process according to claim 5, wherein the liquid bath is saturated with iron.

9. The process according to claim 5, wherein an immersion temperature of the steel is higher than the bath temperature.

10. The process according to claim 5, wherein the bath contains silicon in an amount of about 8% and an immersion temperature ranges between about 700° and about 740° C.

11. The process according to claim 5, wherein the bath contains silicon in an amount of about 9% and an immersion temperature ranges between about 720° and about 765° C.

12. The process according to claim 5, wherein the bath contains silicon in an amount of about 9.5%, and an immersion temperature ranges between about 740° and about 760° C.

13. The process according to claim 5, wherein the steel is a carbon steel casting.

14. The process according to claim 5, wherein the steel is a stainless-steel casting.

15. In a process for aluminizing steel wherein a steel object is dipped into a molten aluminum-based bath and thereafter cooled to obtain an aluminum-containing layer on said steel object, the improvement which comprises maintaining the composition and mean temperature of the bath and the temperature of the steel object as it is immersed in the bath, to provide in an area of the bath where the object is immersed, a liquid/solid equilibrium with a solid θ phase whose composition approximates $FeAl_3$; and continuing the progression of said steel in said bath and adjusting the composition and the mean temperature of said bath to be in equilibrium with a phase designated as τ5 or a phase designated as τ6.

* * * * *